US007213735B1

(12) United States Patent
Ou

(10) Patent No.: US 7,213,735 B1
(45) Date of Patent: May 8, 2007

(54) STAPLE-DRIVING GUN CAPABLE OF ENSURING ATTACHMENT OF A SEAL WASHER TO A SLEEVE

(75) Inventor: Chen-Ho Ou, Tai-Ping (TW)

(73) Assignee: Panrex Industrial Co., Ltd., Tai-ping, Taichung Hsien (TW)

( * ) Notice: Subject to any disclaimer, the term of this patent is extended or adjusted under 35 U.S.C. 154(b) by 0 days.

(21) Appl. No.: 11/378,182

(22) Filed: Mar. 16, 2006

(51) Int. Cl.
*B25C 1/04* (2006.01)
*B21J 15/34* (2006.01)

(52) U.S. Cl. ..... 227/147; 227/107; 227/141; 227/148

(58) Field of Classification Search ..... 227/107, 227/141, 119, 148, 147
See application file for complete search history.

(56) References Cited

U.S. PATENT DOCUMENTS 3,281,046 A * 10/1966 Boulay ..... 227/115
3,542,273 A * 11/1970 Hedrick ..... 227/130
4,196,833 A * 4/1980 Haytayan ..... 227/8
4,744,238 A * 5/1988 Halbert ..... 29/812.5
4,907,730 A * 3/1990 Dion ..... 227/8
5,555,780 A * 9/1996 Beach et al. ..... 81/57.37
6,095,392 A * 8/2000 Batts et al. ..... 227/8
6,155,472 A * 12/2000 Deziel ..... 227/8
6,834,789 B1 * 12/2004 Dion et al. ..... 227/148

* cited by examiner

*Primary Examiner*—Brian Nash
(74) *Attorney, Agent, or Firm*—Timothy W. Lohse; DLA Piper US LLP

(57) ABSTRACT

A staple-driving gun includes a hollow housing configured with first and second air chambers separated by a partition. A piston unit includes an operating member connected fixedly to a sleeve disposed movably in the first air chamber, and a piston rod disposed movably in the sleeve. The operating member is operable so as to move a valve end portion of the sleeve away from the partition. Hence, compressed air flows from the first air chamber into the second air chamber via a valve hole in the partition, and an air-excluding passage constituted by a gap between the valve end portion of the sleeve and an annular flange of a seal washer mounted on the valve end portion of the sleeve, and an air-excluding hole in the valve end portion of the sleeve so as to urge the piston rod to move toward a staple-discharging member.

1 Claim, 7 Drawing Sheets

STAPLE-DRIVING GUN CAPABLE OF ENSURING ATTACHMENT OF A SEAL WASHER TO A SLEEVE

BACKGROUND OF THE INVENTION

1. Field of the Invention

The invention relates to a staple-driving gun, more particularly to a staple-driving gun capable of ensuring attachment of a seal washer to a sleeve.

2. Description of the Related Art

Referring to FIG. 1, a conventional staple-driving gun is shown to include a gun body 1, a staple cartridge 3, and a piston unit 2.

The gun body 1 includes a handle 102, a staple-discharging member 103 formed with a staple-discharging hole 1032 that extends along an axis, and a hollow housing 101 connected fixedly to the handle 102 and having a first open end 1011, and a second open end 1012 opposite to the first open end 1011 along the axis and connected to the staple-discharging member 103. The housing 101 is configured with an inner surface that is divided into first and second air chambers 105, 106 by a partition 104 that is disposed fixedly in the housing 101 and that is formed with a valve hole 104'. The housing 101 is formed with an air inlet 109 in spatial communication with the first air chamber 105 for permitting compressed air to be fed into the first air chamber 105 therethrough.

The staple cartridge 3 is attached fixedly to the staple-discharging member 103, and is capable of receiving a row of staples (not shown) so as to feed the staples into the staple-discharging hole 1032 in the staple-discharging member 103 one at a time.

The piston unit 20 includes: a sleeve 201 disposed in the first air chamber 15, and having a coupling end portion 205 disposed movably in the first open end 1011 of the housing 101, and an enlarged valve end portion 207 disposed movably in the second air chamber 106, having an outer diameter larger than a diameter of the valve hole 104' in the partition 104, and having an annular outer surface 2071 formed with an annular engaging groove 2072; a seal washer 209 sleeved on the valve end portion 207 of the sleeve 201 in a close fitting manner and having an inwardly extending annular flange 2091 that engages the annular engaging groove 2072 in the valve end portion 207 of the sleeve 201; an operating member 206 connected fixedly to the coupling end portion 205 of the sleeve 201, disposed outwardly of the housing 101, and movable along the axis; and a piston rod 202 disposed movably in the sleeve 202 and having a diameter-increased first piston end 2021 that is in slidable and sealing contact with the sleeve 201, and a second piston end 2022 opposite to the first piston end 2021 along the axis, extending outwardly of the sleeve 201, and disposed movably and sealingly in the second air chamber 106. The second piston end 2022 of the piston rod 202 has a fixed staple-striking piece 204 that extends along the axis into the staple-discharging hole 1032 in the staple-discharging member 103.

The operating member 206 is operable so as to move the sleeve 201 from a standby position, where the seal washer 209 is in sealing contact with the partition 104 so as to seal the valve hole 104' in the partition 104 such that flow of the compressed air from the first air chamber 105 into the second air chamber 106 through the valve hole 104' in the partition 104 is prevented, as shown in FIG. 1, to a staple-discharging position, where the valve end portion 207 of the sleeve 201 is separated from the partition 104 so as to allow flow of the compressed air from the first air chamber 105 into the second air chamber 106 through the valve hole 104' in the partition 104 such that the compressed air flowing from the first air chamber 105 into the second air chamber 106 via the valve hole 104' in the partition 104 urges the second piston end 2022 of the piston rod 202 to move toward the second open end 1012 of the housing 101, thereby discharging one of the staples in the staple-discharging hole 1032 in the staple-discharging member 103 in response to one strike of the staple-striking piece 204 thereon, as shown in FIG. 2.

It is noted that, when the sleeve 201 is moved from the standby position to the staple-discharging position, the annular flange 2091 of the seal washer 209 is removed from the annular engaging groove 2072 in the valve end portion 207 of the sleeve 201 by the compressed air flowing from the first air chamber 105 into the second air chamber 106, thereby resulting in deformation of the seal washer 209, as best shown in FIG. 3. As such, after staple discharging, the annular flange 2091 hardly restores to once again engage the annular engaging groove 2072 in the valve end portion 207 of the sleeve 201 such that attachment of the seal washer 209 to the valve end portion 207 of the sleeve 201 cannot be ensured.

SUMMARY OF THE INVENTION

Therefore, the object of the present invention is to provide a staple-driving gun that is capable of ensuring attachment of a seal washer to a sleeve.

According to the present invention, a staple-driving gun comprises:

a gun body including a handle, a hollow housing connected fixedly to the handle, and having first and second open ends opposite to each other along an axis, the housing being configured with an inner space and further having a partition disposed fixedly in the inner space so as to divide the inner space into a first air chamber disposed adjacent to the first open end, and a second air chamber disposed adjacent to the second open end, the partition being formed with a valve hole, the axis extending through the valve hole in the partition, the housing being formed with an air inlet in spatial communication with the first air chamber for permitting compressed air to be fed into the first air chamber therethrough, and a staple-discharging member mounted on the second open end of the housing and formed with a staple-discharging hole that extends along the axis;

a staple cartridge attached fixedly to the staple-discharging member, and adapted to receive a row of staples so as to feed the staples into the staple-discharging hole in the staple-discharging member one at a time; and a piston unit including a sleeve disposed in the first air chamber, movable along the axis, and having a coupling end portion disposed movably in the first open end of the housing, and an enlarged valve end portion disposed movably in the second air chamber and having an outer diameter larger than a diameter of the valve hole in the partition, the valve end portion of the sleeve having an annular outer surface formed with an annular engaging groove, and being formed with an air-excluding hole in spatial communication with the annular engaging groove, a seal washer sleeved on the valve end portion of the sleeve in a close fitting manner and having an inwardly extending annular flange that engages the annular engaging groove in the valve end portion of the sleeve, an operating member connected fixedly to the coupling end portion of the sleeve, disposed outwardly of the housing, and movable along the axis, and a hollow piston rod disposed movably in the sleeve and having a diameter-increased first piston end that is in slidable and sealing contact with the sleeve, a second piston end that is opposite to the first piston end along the axis, that extends outwardly of the sleeve, and that is disposed movably and sealingly in the second air chamber, and an intermediate rod portion disposed between and interconnecting the first and second piston ends, the second piston end of the piston rod having a fixed staple-striking piece that extends along the axis into the staple-discharging hole in the staple-discharging member.

The operating member is operable so as to move the sleeve from a standby position, where the seal washer is in sealing contact with the partition and the valve end portion of the sleeve so as to seal the valve hole in the partition such that flow of the compressed air from the first air chamber into the second air chamber through the valve hole in the partition is prevented, to a staple-discharging position, where the valve end portion of the sleeve is separated from the partition so as to allow flow of the compressed air from the first air chamber into the second air chamber through the valve hole in the partition such that the compressed air flowing from the first air chamber into the second air chamber via the valve hole in the partition urges the second piston end of the piston rod to move toward the second open end of the housing, thereby discharging one of the staples in the staple-discharging hole in the staple-discharging member in response to one strike of the staple-striking piece thereon.

When the sleeve is moved from the standby position to the staple-discharging position, at least one portion of the annular flange of the seal washer is removed from the annular engaging groove in the valve end portion of the sleeve by the compressed air flowing from the first air chamber into the second air chamber, thereby forming a gap between the valve end portion of the sleeve and the annular flange of the seal washer. The gap is in spatial communication with and cooperates with the air-excluding hole in the valve end portion of the sleeve so as to constitute an air-excluding passage for excluding the compressed air from the annular engaging groove in the valve end portion of the sleeve.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
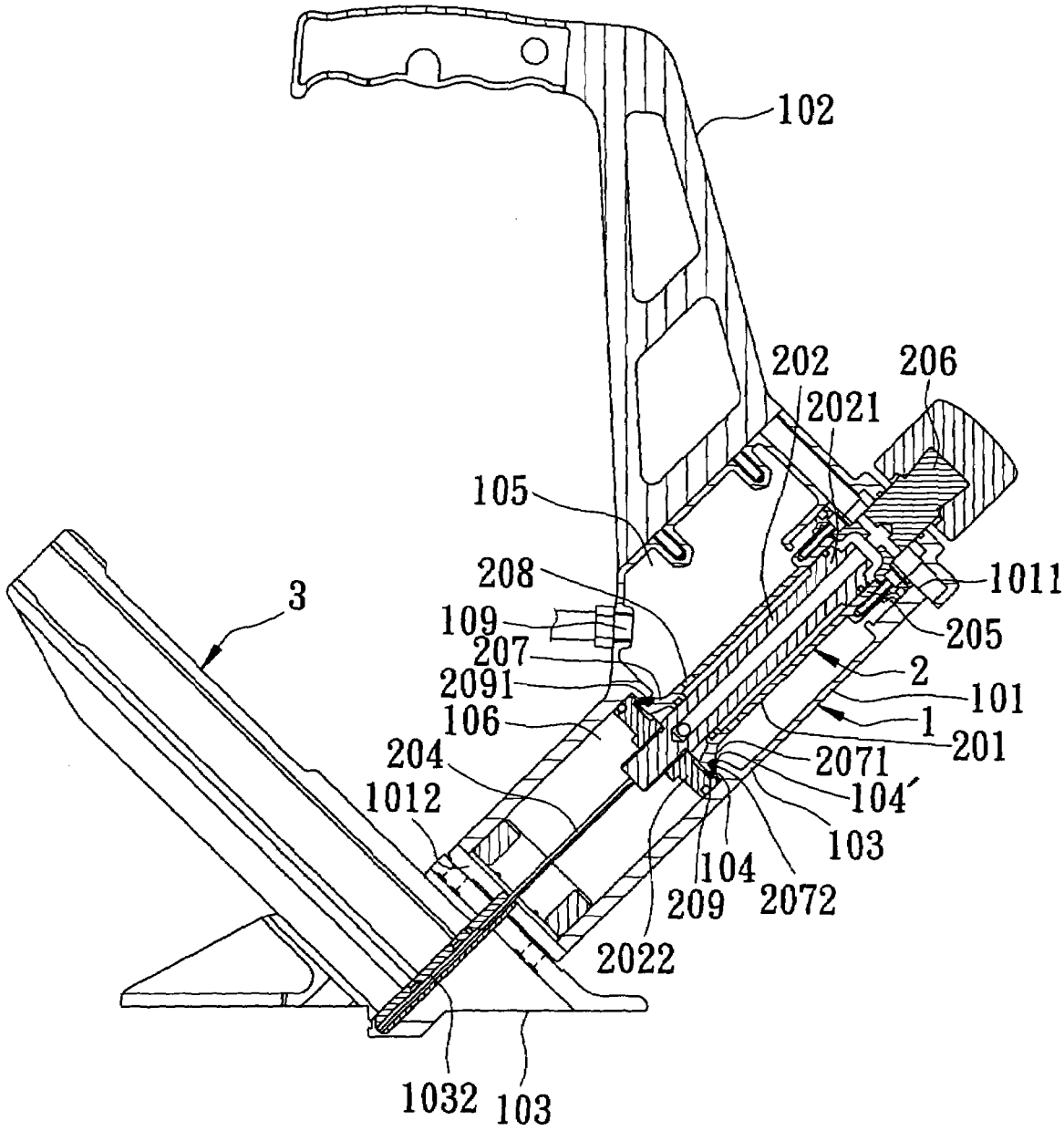
FIG. 1 PRIOR ART
FIG. 1 is a schematic sectional view of a conventional staple-driving gun.
Figure 2:
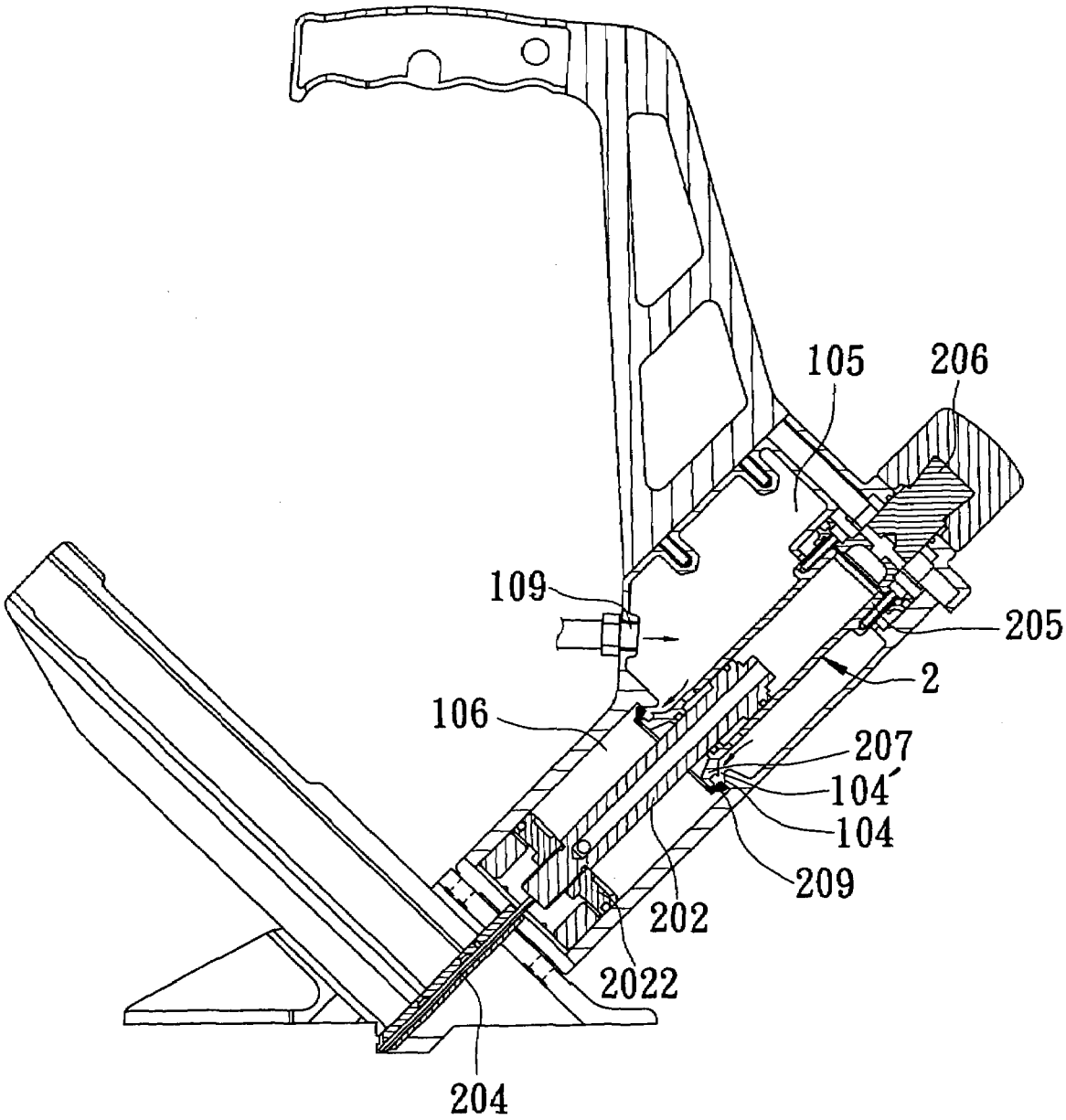
FIG. 2 PRIOR ART
FIG. 2 is a schematic sectional view of the conventional staple-driving gun when a sleeve is moved to a staple-discharging position by a normal operation of an operating member.
Figure 3:
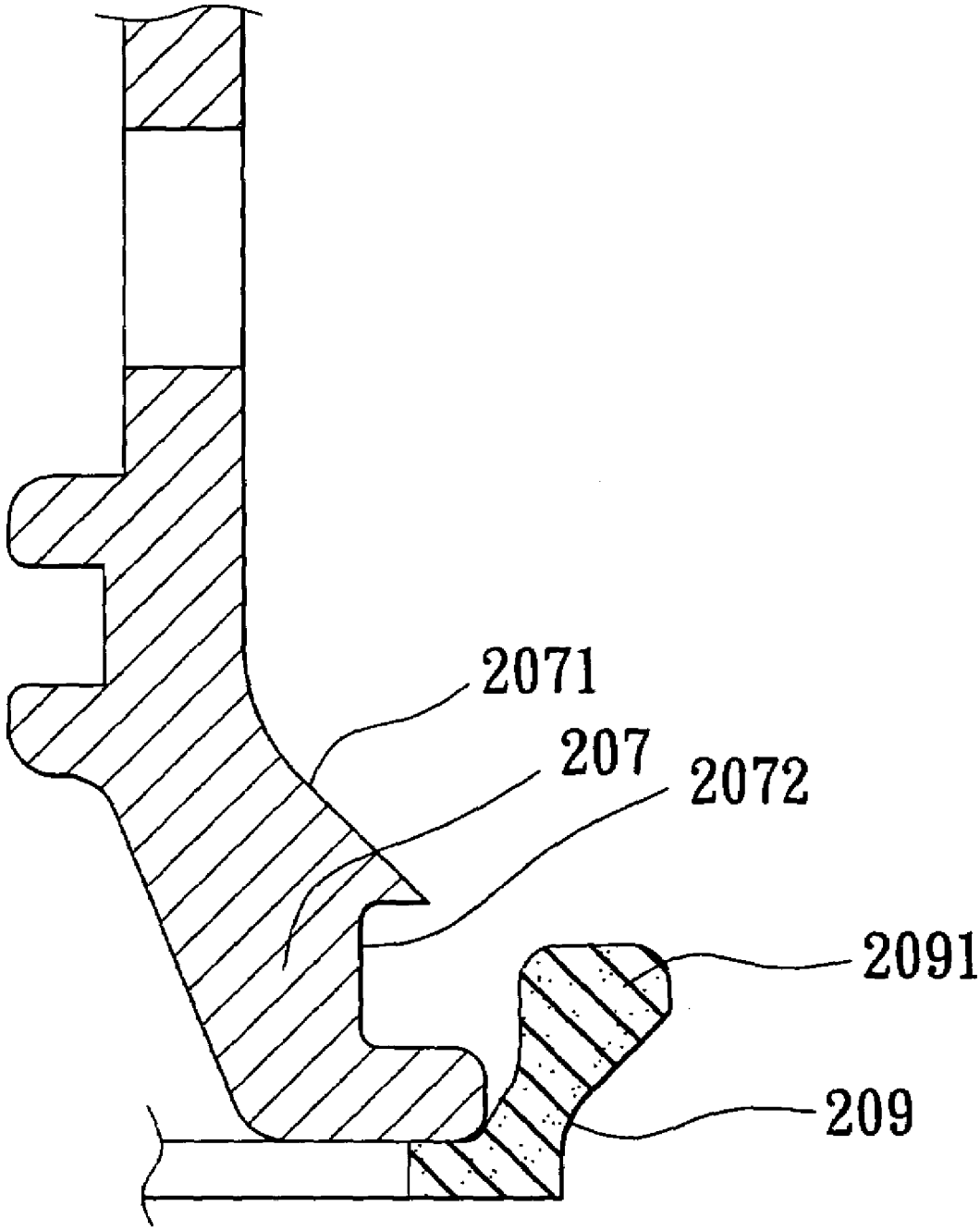
FIG. 3 PRIOR ART
FIG. 3 is a fragmentary schematic sectional view illustrating a deformed seal washer sleeved on the sleeve of the conventional staple-driving gun.
Figure 4:
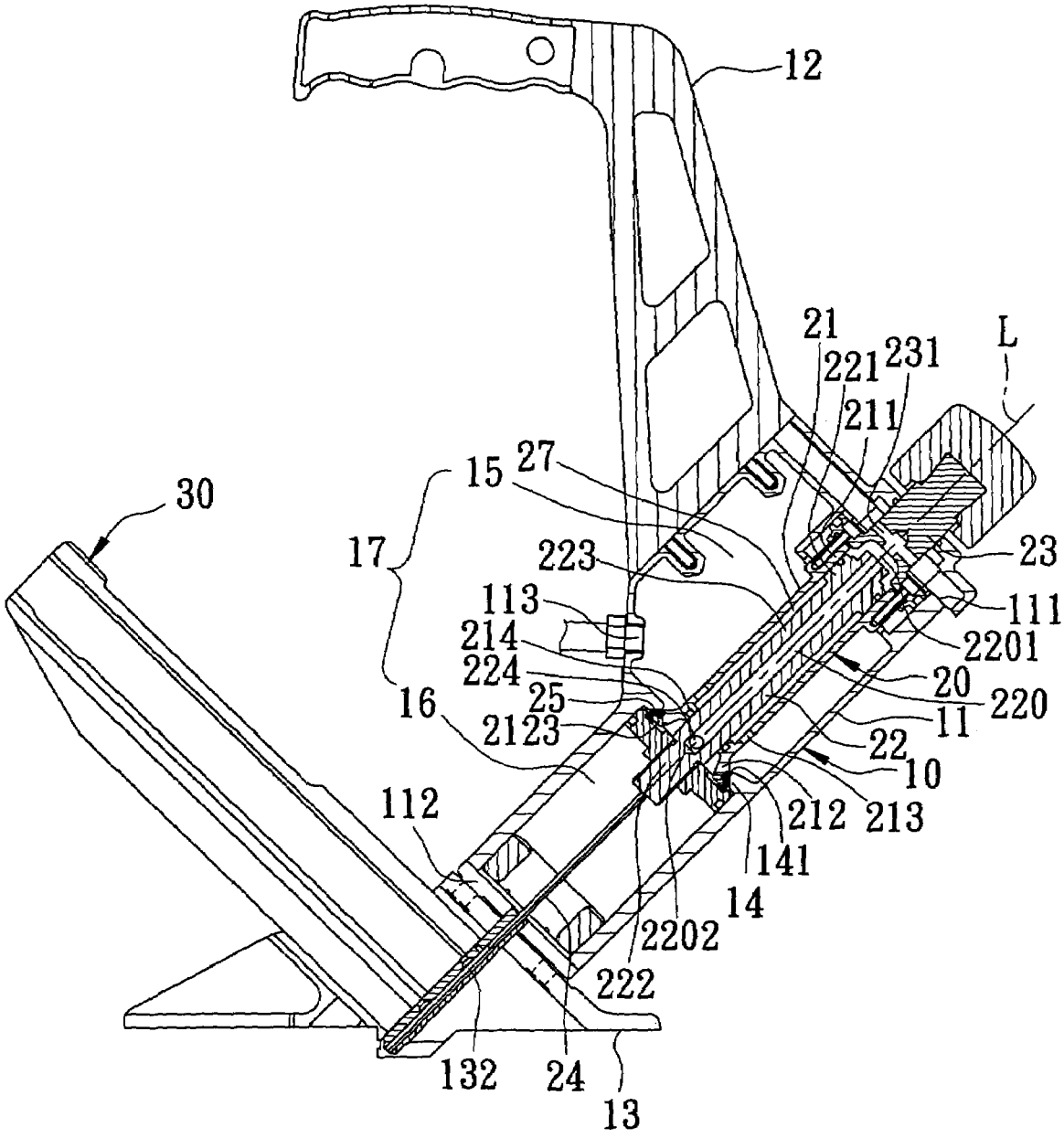
FIG. 4 is a schematic sectional view showing the preferred embodiment of a staple-driving gun according to the present invention.

Referring to FIG. 4, the preferred embodiment of a staple-driving gun according to the present invention is shown to include a gun body 10, a staple cartridge 30, and a piston unit 20.

The gun body 10 includes a handle 12, a hollow housing 11, and a staple-discharging member 13.

The housing 11 is connected fixedly to the handle 12, and has first and second open ends 111, 112 opposite to each other along an axis (L). The housing 11 is configured with an inner space 17, and has a partition 14 disposed fixedly in the inner space 17 and perpendicular to the axis (L) so as to divide the inner space 17 into a first air chamber 15 disposed adjacent to the first open end 111, and a second air chamber 16 disposed adjacent to the second open end 112. The partition 14 is formed with a valve hole 141. The axis (L) extends through the valve hole 141 in the partition 14. The housing 11 is formed with an air inlet 113 in spatial communication with the first air chamber 15 for permitting compressed air to be fed into the first air chamber 15 therethrough.

The staple-discharging member 13 is mounted on the second open end 112 of the housing 11, and is formed with a staple-discharging hole 132 that extends along the axis (L).

The staple cartridge 30 is attached fixedly to the staple-discharging member 13, and is adapted to receive a row of staples (not shown) so as to feed the staples into the staple-discharging hole 132 in the staple-discharging member 13 one at a time.

The piston unit 20 includes a sleeve 21, a seal washer 25, an operating member 23, and a hollow piston rod 22.

Figure 6:
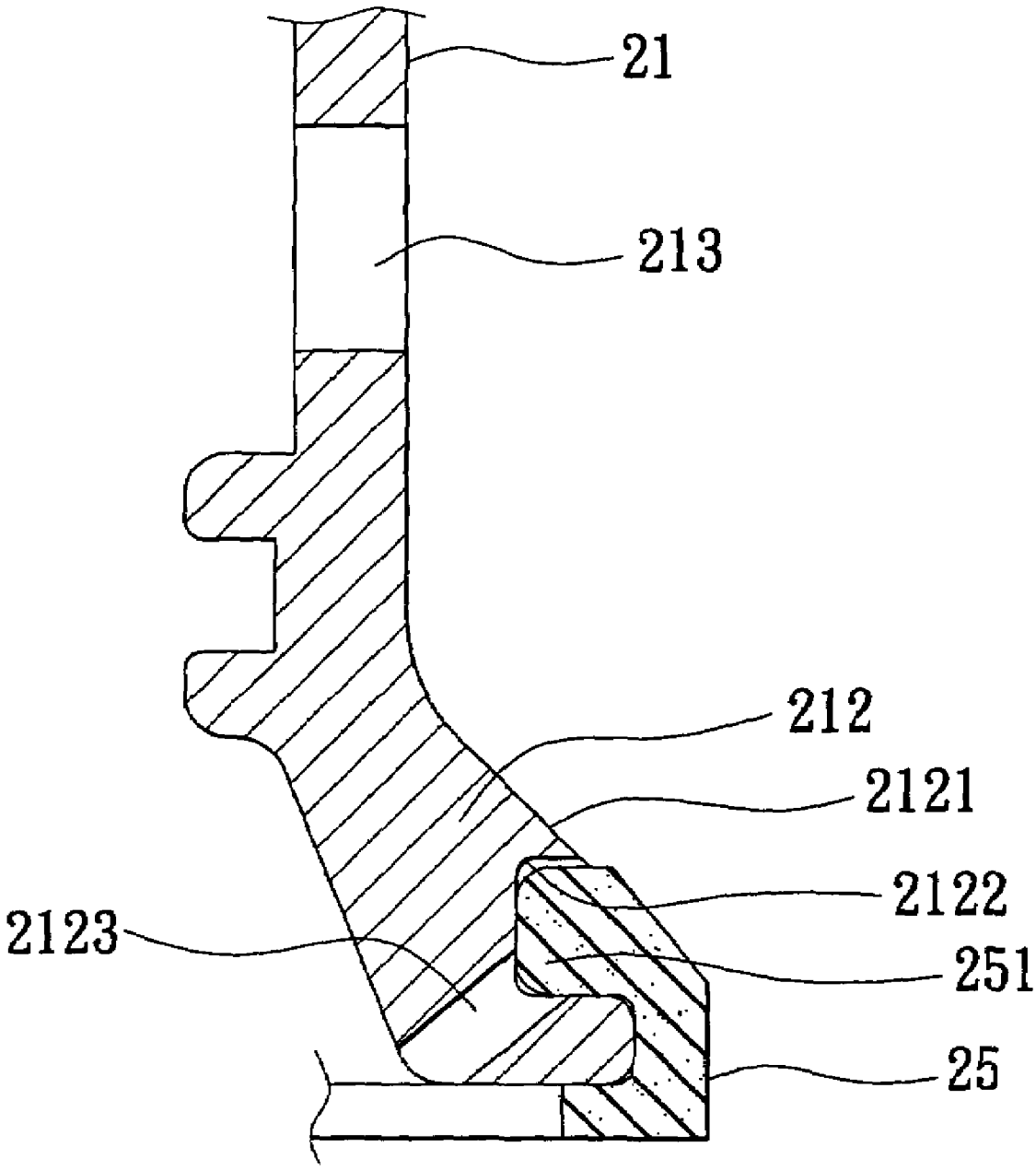
FIG. 6 is a fragmentary schematic sectional view illustrating a seal washer sleeved on the sleeve of the preferred embodiment.

The sleeve 21 is disposed in the first air chamber 15, and is movable along the axis (L). The sleeve 21 has a coupling end portion 211 disposed movably in the first open end 111 of the housing 11, and an enlarged valve end portion 212 disposed movably in the second air chamber 16 and having an outer diameter larger than a diameter of the valve hole 141 in the partition 14. With further reference to FIG. 6, the valve end portion 212 of the sleeve 21 has an annular outer surface 2121 formed with an annular engaging groove 2122, and is formed with an air-excluding hole 2123 in spatial communication with the annular engaging groove 2122. In this embodiment, the sleeve 21 is formed with a plurality of air guiding holes 213 disposed adjacent to the valve end portion 212. The sleeve 21 further has a radially and inwardly extending integral inward flange 214 that is disposed between the valve end portion 212 and the air guiding holes 213.

The seal washer 25 is sleeved on the valve end portion 212 of the sleeve 21 in a close fitting manner, and has an inwardly extending annular flange 251 that engages the annular engaging groove 2122 in the valve end portion 212 of the sleeve 21, as best shown in FIG. 6.

The operating member 23 is connected fixedly to the coupling end portion 211 of the sleeve 21, is disposed outwardly of the housing 11, and is movable along the axis (L). In this embodiment, the operating member 23 is formed with an air outlet 231.

The piston rod 22 is disposed movably in the sleeve 21, and has a diameter-increased first piston end 221, a second piston end 222, and an intermediate rod portion 223. The first piston end 221 of the piston rod 22 is in slidable and sealing contact with the sleeve 21. The second piston end 222 of the piston rod 22 is opposite to the first piston end 221 along the axis (L), extends outwardly of the sleeve 21, and is disposed movably and sealingly in the second air chamber 16. The intermediate rod portion 223 of the piston rod 22 is disposed between and interconnects the first and second piston ends 221, 222, and is in slidable and sealing contact with the inward flange 214 of the sleeve 21. The second piston end 222 of the piston rod 22 has a fixed staple-striking piece 24 that extends along the axis (L) into the staple-discharging hole 132 in the staple-discharging member 13. In this embodiment, the sleeve 21 cooperates with the piston rod 22 to define a volume-changeable annular third air chamber 27 among the inward flange 214 of the sleeve 21, and the first piston end 221 and the intermediate rod portion 223 of the piston rod 22. The air guiding holes 213 in the sleeve 21 are in spatial communication with the first and third air chambers 15, 27. In this embodiment, the piston rod 22 defines an inner axial hole 220, and is formed with a through hole 224 disposed adjacent to the second piston end 222 and in spatial communication with the inner axial hole 220. The inner axial hole 220 has an open end 2201 formed in the first piston end 221 of the piston rod 22, and a closed end 2202 disposed adjacent to the second piston end 222 of the piston rod 22. The through hole 224 and the inner axial hole 220 in the piston rod 22 cooperate with the air outlet 231 in the operating member 23 to constitute an air discharging passage.

Figure 5:
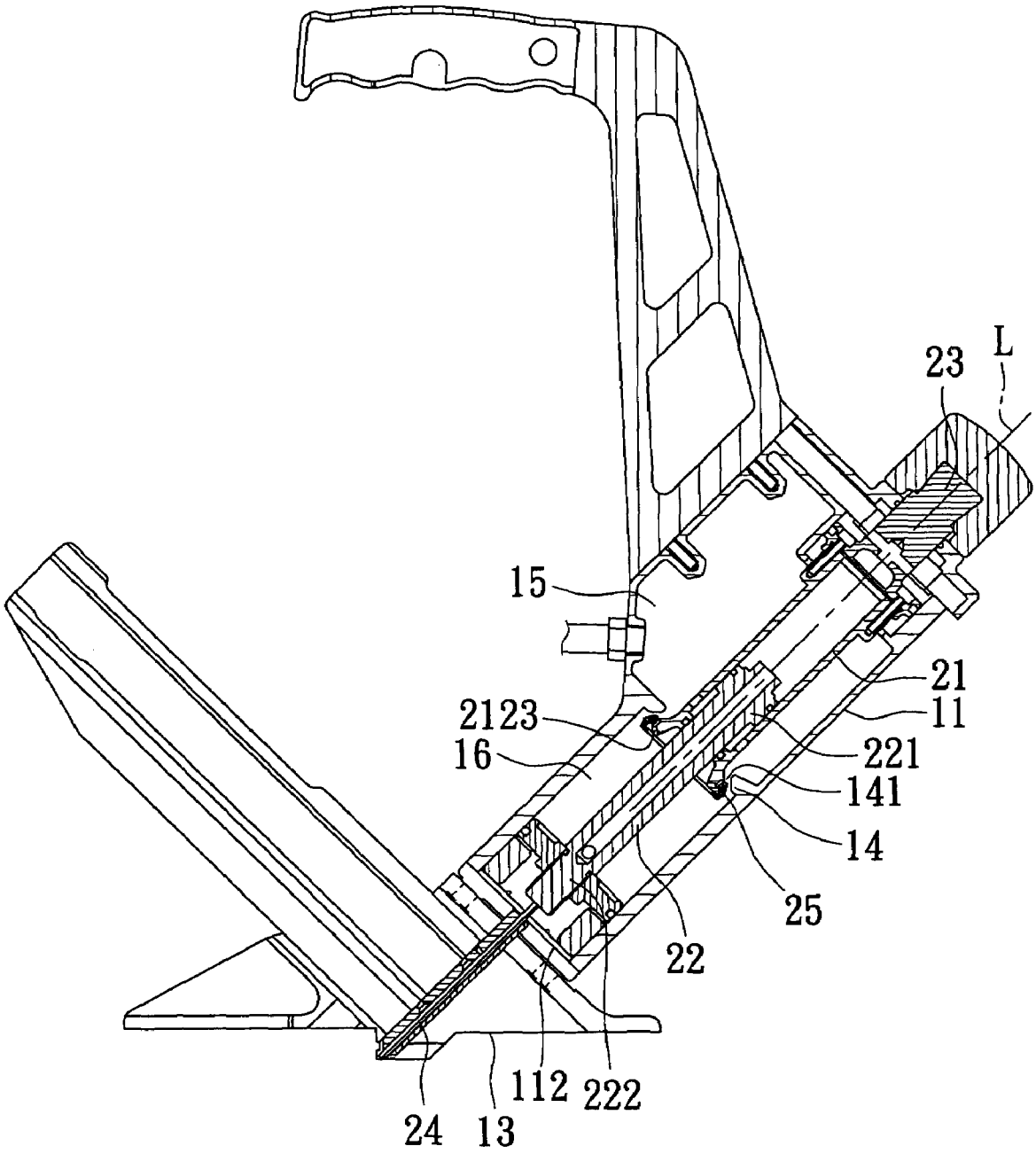
FIG. 5 is a schematic sectional view showing the preferred embodiment when a sleeve is moved to a staple-discharging position.

In use, the operating member 23 of the piston unit 20 is operable so as to move the sleeve 21 from a standby position, where the seal washer 25 is in sealing contact with the partition 14 and the valve end portion 212 of the sleeve 21 so as to seal the valve hole 141 in the partition 14 such that flow of the compressed air from the first air chamber 15 into the second air chamber 16 through the valve hole 141 in the partition 14 is prevented, as shown in FIG. 4, to a staple-discharging position, where the valve end portion 212 of the sleeve 21 is separated from the partition 14 so as to allow flow of the compressed air from the first air chamber 15 into the second air chamber 16 through the valve hole 141 in the partition 14 such that the compressed air flowing from the first air chamber 15 into the second air chamber 16 via the valve hole 141 in the partition 14 urges the second piston end 222 of the piston rod 22 of the piston unit 20 to move toward the second open end 112 of the housing 11, thereby discharging one of the staples in the staple-discharging hole 132 in the staple-discharging member 13 in response to one strike of the staple-striking piece 24 thereon, as shown in FIG. 5. Thereafter, the compressed air in the second air chamber 16 is discharged to the outside via the air-discharging passage, and simultaneously, the compressed air flowing from the first air chamber 15 into the third air chamber 27 via the air guiding holes 213 in the sleeve 21 urges the first piston end 221 of the piston rod 22 toward the first open end 111 of the housing 11.

Figure 7:
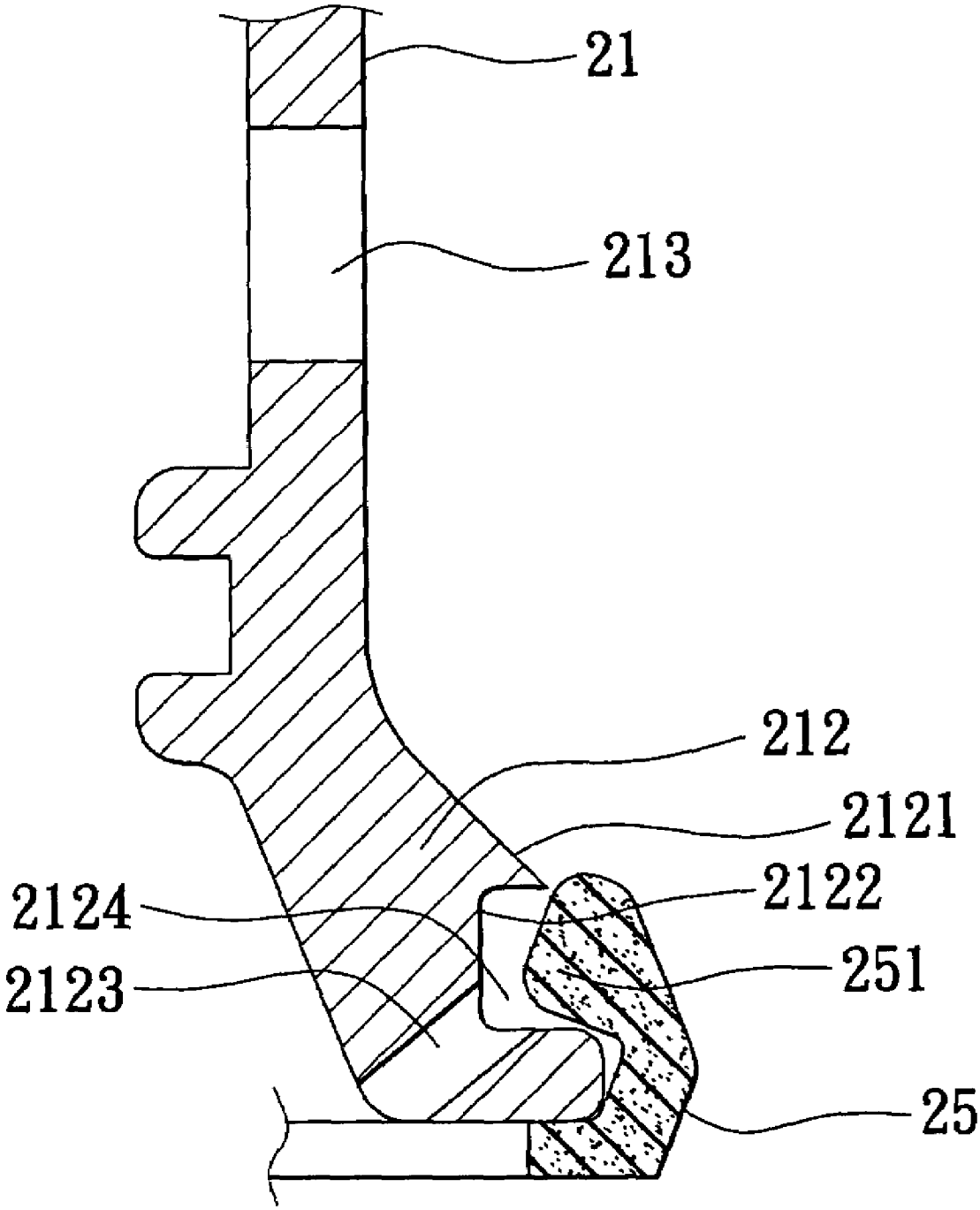
FIG. 7 is a fragmentary schematic sectional view illustrating deformation of the seal washer when the sleeve is in the staple-discharging position.

It is noted that, when the sleeve 21 is moved from the standby position to the staple-discharging position, at least one portion of the annular flange 251 of the seal washer 25 is removed from the annular engaging groove 2122 in the valve end portion 212 of the sleeve 21 by the compressed air flowing from the first air chamber 15 into the second air chamber 16, thereby forming a gap 2124 between the valve end portion 212 of the sleeve 21 and the annular flange 251 of the seal flange 25, as best shown in FIG. 7. In this case, the gap 2124 is in spatial communication with and cooperates with the air-excluding hole 2123 in the valve end portion 212 of the sleeve 21 so as to constitute an air-excluding passage for excluding the compressed air from the annular engaging groove 2122 in the valve end portion 212 of the sleeve 21.

As such, due to the presence of the air-excluding hole 2123 in the valve end portion 212 of the sleeve 21, the compressed air in the annular engaging groove 2122 in the valve end portion 212 of the sleeve 21 can be effectively excluded such that the annular flange 251 of the seal washer 25 can be easily restored to engage the annular engaging groove 2122 in the valve end portion 212 of the sleeve 21 when the sleeve 21 is moved from the staple-discharging position back to the standby position. In view of this, deformation of the seal washer 25 occurring in the aforesaid conventional staple-driving gun can be avoided even after a long period of use, thereby ensuring attachment of the seal washer 25 to the valve end portion 212 of the sleeve 21.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A staple-driving gun comprising:

a gun body including a handle, a hollow housing connected fixedly to said handle, and having first and second open ends opposite to each other along an axis, said housing being configured with an inner space and further having a partition disposed fixedly in said inner space so as to divide said inner space into a first air chamber disposed adjacent to said first open end, and a second air chamber disposed adjacent to said second open end, said partition being formed with a valve hole, the axis extending through said valve hole in said partition, said housing being formed with an air inlet in spatial communication with said first air chamber for permitting compressed air to be fed into said first air chamber therethrough, and a staple-discharging member mounted on said second open end of said housing and formed with a staple-discharging hole that extends along the axis;

a staple cartridge attached fixedly to said staple-discharging member, and adapted to receive a row of staples so as to feed the staples into said staple-discharging hole in said staple-discharging member one at a time; and a piston unit including a sleeve disposed in said first air chamber, movable along the axis, and having a coupling end portion disposed movably in said first open end of said housing, and an enlarged valve end portion disposed movably in said second air chamber and having an outer diameter larger than a diameter of said valve hole in said partition, said valve end portion of said sleeve having an annular outer surface formed with an annular engaging groove, and being formed with an air-excluding hole in spatial communication with said annular engaging groove, a seal washer sleeved on said valve end portion of said sleeve in a close fitting manner and having an inwardly extending annular flange that engages said annular engaging groove in said valve end portion of said sleeve, an operating member connected fixedly to said coupling end portion of said sleeve, disposed outwardly of said housing, and movable along the axis, and a hollow piston rod disposed movably in said sleeve and having a diameter-increased first piston end that is in slidable and sealing contact with said sleeve, a second piston end that is opposite to said first piston end along the axis, that extends outwardly of said sleeve, and that is disposed movably and sealingly in said second air chamber, and an intermediate rod portion disposed between and interconnecting said first and second piston ends, said second piston end of said piston rod having a fixed staple-striking piece that extends along the axis into said staple-discharging hole in said staple-discharging member, said operating member being operable so as to move said sleeve from a standby position, where said seal washer is in sealing contact with said partition and said valve end portion of said sleeve so as to seal said valve hole in said partition such that flow of the compressed air from said first air chamber into said second air chamber through said valve hole in said partition is prevented, to a staple-discharging position, where said valve end portion of said sleeve is separated from said partition so as to allow flow of the compressed air from said first air chamber into said second air chamber through said valve hole in said partition such that the compressed air flowing from said first air chamber into said second air chamber via said valve hole in said partition urges said second piston end of said piston rod to move toward said second open end of said housing, thereby discharging one of the staples in said staple-discharging hole in said staple-discharging member in response to one strike of said staple-striking piece thereon, wherein, when said sleeve is moved from the standby position to the staple-discharging position, at least one portion of said annular flange of said seal washer is removed from said annular engaging groove in said valve end portion of said sleeve by the compressed air flowing from said first air chamber into said second air chamber, thereby forming a gap between said valve end portion of said sleeve and said annular flange of said seal washer, said gap being in spatial communication with and cooperating with said air-excluding hole in said valve end portion of said sleeve so as to constitute an air-excluding passage for excluding the compressed air from said annular engaging groove in said valve end portion of said sleeve.

* * * * *